United States Patent [19]

Meek

[11] Patent Number: 4,718,494

[45] Date of Patent: Jan. 12, 1988

[54] METHODS AND APPARATUS FOR SELECTIVELY CONTROLLING FLUID COMMUNICATION BETWEEN A PIPE STRING AND A WELL BORE ANNULUS

[75] Inventor: Dale E. Meek, Sugar Land, Tex.

[73] Assignee: Schlumberger Technology Corporation, Houston, Tex.

[21] Appl. No.: 814,700

[22] Filed: Dec. 30, 1985

[51] Int. Cl.[4] ..... E21B 34/08

[52] U.S. Cl. ..... 166/373; 166/319; 166/330

[58] Field of Search ..... 166/319, 330, 331, 373, 166/374

[56] References Cited

U.S. PATENT DOCUMENTS

| | | | |
|---|---|---|---|
| Re. 29,638 | 5/1978 | Nutter | 166/128 X |
| 3,442,328 | 5/1969 | Nutter | 166/331 X |
| 3,446,280 | 5/1969 | Nutter | 166/331 X |
| 3,969,937 | 7/1976 | Banington et al. | 166/264 X |
| 3,986,554 | 10/1976 | Nutter | 166/319 |
| 4,403,659 | 9/1983 | Upchufel | 166/374 |
| 4,452,313 | 6/1984 | McMahan | 166/323 X |
| 4,573,536 | 3/1986 | Lawrence | 166/373 |

*Primary Examiner*—George A. Suchfield

[57] ABSTRACT

In the representative embodiments of the new and improved methods and apparatus disclosed herein, a full-bore reversing and circulating valve is cooperatively arranged to be tandemly coupled in a typical string of drillstem testing tools including a pressure-actuated test valve. Pressure-actuated valve means are arranged within the housing of the new and improved apparatus of the present invention and adapted for movement therein in an extended span of travel between spaced upper and lower port-opening positions in response to changes in the direction of the pressure differential acting on the valve means. Indexing means are provided which include a sleeve member rotatably arranged on the valve means and ratchet-and-pawl means cooperatively arranged for incrementally advancing the sleeve along multiple angular positions around the valve means in response to the longitudinal movements of the valve means. Stop means are also provided on the valve means and sleeve for blocking the movement of the valve means to its port-opening positions until the sleeve has been advanced to a predetermined angular position in relation to the valve means.

10 Claims, 6 Drawing Figures

METHODS AND APPARATUS FOR SELECTIVELY CONTROLLING FLUID COMMUNICATION BETWEEN A PIPE STRING AND A WELL BORE ANNULUS

BACKGROUND OF THE INVENTION

This invention relates to well bore testing methods and apparatus employing a new and improved pressure-actuated full-bore reversing valve arranged to be tandemly coupled to a packer and a pressure-actuated test valve which, when the tools are suspended in a well bore from a pipe string, is selectively operated in response to successive changes in the pressure differential between the interior of the pipe string and the well bore annulus for carrying out a series of test operations. More particularly, the present invention relates to a new and improved full-bore reversing valve having reversing ports which initially are kept closed for blocking communication between the well bore annulus and the interior of the pipe string until a predetermined number of these pressure differential changes have been applied to the reversing valve. Thereafter, the next change in the pressure differential is effective for selectively opening the reversing ports and a subsequent pressure differential change will then reclose the ports thereby readying the new and improved tool for a second operating cycle should it be desired to conduct additional testing or completion operations before the string of tools is removed from the well bore.

BACKGROUND ART

Those skilled in the art will, of course, appreciate that a typical string of drillstem testing tools usually includes a reversing valve which is operated when it is desired to recover whatever connate fluids that were produced during a previous flow test. Typically, following a flow test, the reversing valve is opened to admit the fluids in the well bore annulus into the tool string above the closed test valve. Then, by applying pressure to the annulus fluids, the connate fluids will be displaced from the pipe string and recovered at the surface.

In present-day operations it is generally preferred that insofar as is practical the several tools in a given string of drillstem testing tools be operated by selectively changing the pressure of either the fluids in the well bore annulus or the fluids in the pipe string. Such selective pressure actuation ordinarily presents no particular problem so long as the various tools in a given tool string can be reliably controlled with only a limited number of pressure changes. Those skilled in the art will recognize, however, that these tools are necessarily more complicated if two or more of the tools in a given tool string are respectively arranged to be repetitively cycled through more than one operating cycle. For instance, before the invention of the new and improved reversing valve disclosed in U.S. Pat. No. 4,403,659, it was difficult to provide a reliable and economical preasure-actuated reversing valve that could be effectively combined with a pressure-actuated test valve and selectively operated as needed for recovering one or more fluid samples as well as conducting additional testing or completion operations without having to remove the tool string from the well bore.

Although the new and improved pressure-actuated valve disclosed in the aforementioned U.S. Pat. No. 4,403,659 has met with considerable commercial success, there are nevertheless some limitations to its use.

For instance, the successful operation of that tool requires that a biasing spring always functions to return the tool mandrel to its elevated position each time the tubing pressure is reduced. Thus, should the annular spaces between the mandrel and the housing of the valve become unduly clogged with debris or solids in the well bore fluids, this biasing spring might lack sufficient strength to overcome this increased frictional force thereby preventing the subsequent opening of the reversing ports at the end of a testing cycle. Moreover, at times it is desired to conclude a testing operation by spotting a stimulation fluid such as an acid in the well bore before the tool string is removed. Such a spotting operation, of course, requires that the reversing ports remain open as the stimulation fluids are pumped down the pipe string and through the ports into the annulus of the well bore. However, with the reversing valve described in the aforementioned patent, where the stimulation fluid is a relatively non-compressible liquid the pumping rate of this fluid must be carefully limited so that the increased pressure in the pipe string will not inadvertently shift the mandrel downwardly and thereby prematurely close the reversing ports. This reduced pumping rate will, of course, correspondingly increase the time that the string of testing tools must be left in the well bore. On the other hand, where the stimulation fluid is a nitrified acid or some other slightly compressible fluid, it has been found that extreme pumping rates are required with this reversing valve to sufficiently increase the pressure in the pipe string for moving the mandrel downwardly against its biasing spring to reclose the reversing valve once the spotting operation is completed.

OBJECTS OF THE INVENTION

Accordingly, it is an object of the present invention to provide new and improved methods and apparatus for selectively controlling fluid communication between a pipe string suspended in a well bore and the well bore annulus.

It is a further object of the present invention to provide new and improved pressure-actuated well tools which are selectively controlled from the surface by successive changes in the pressure differential between the well bore annulus and the pipe string.

SUMMARY OF THE INVENTION

These and other objects of the present invention are attained by providing a new and improved well tool having an inner tubular member that is telescopically disposed within an outer tubular member and including piston means cooperatively arranged for selectively reciprocating the inner member between upper and lower positions within the outer member in response to successive changes in the pressure differential acting on the piston means. New and improved indexing means are cooperatively arranged between the telescoped members and adapted for limiting the movements of the inner member to one longitudinal span of travel until the inner member has been successively reciprocated a predetermined number of times. The indexing means then operate to temporarily free the inner member for movement in an alternate span of travel before it is again limited to travel only in its initial span of travel. Valve means are arranged on the well tool to be selectively controlled by the longitudinal movements of the inner member in at least one of its travel spans.

BRIEF DESCRIPTION OF THE DRAWINGS

The novel features of the present invention are set forth with particularity in the appended claims. The invention, together with further objects and advantages thereof, may best be understood by way of illustration of the following description of exemplary methods and apparatus employing the principles of the invention as illustrated in the accompanying drawings in which:

DESCRIPTION OF A PREFERRED EMBODIMENT

Figure 1:
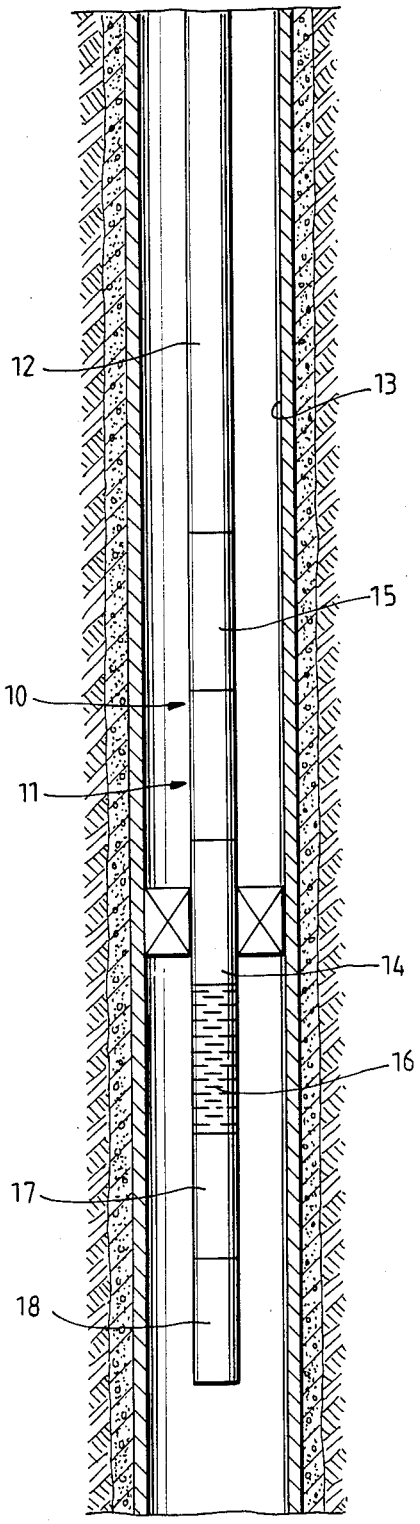
FIG. 1 shows a typical string of drillstem testing tools including a new and improved reversing valve employing the principles of the present invention as the tool string will appear when it is suspended in a typical cased well bore.

Turning now to FIG. 1, a new and improved full-bore valve 10 is shown tandemly coupled to a string of full-bore tools, as shown generally at 11, which is dependently suspended from a string of pipe, such as a typical drill string 12, and selectively operated from the surface for performing various testing and completion operations at one or more selected depths in a cased well bore 13. It should be recognized, of course, that the new and improved methods and apparatus of the present invention can also be employed with equal success in uncased boreholes.

As one example of a preferred embodiment and one manner for practicing the present invention, the particular assembly of tools 11 shown In FIG. 1 includes a typical full-bore packer 14 which is adapted to be set at a selected depth in the well bore 13 for isolating a formation interval to be tested from the fluids in the well bore above the packer. The tool string 11 also includes a full-bore test valve 15 (such as the test valve disclosed in U.S. Pat. No. Re. 29,638) which is operated by selectively increasing and decreasing the pressure of the fluids in the annulus of the well bore 13 above the packer 14. As is common, a perforated tail pipe 16 is dependently coupled to the packer 14 for admitting connate fluids into the tool assembly 11 and the pipe string 12 whenever the test valve 15 is opened. To provide a record of pressure changes in the well bore interval isolated by the packer 14 during the flow and shut-in tests, one or more self-contained pressure recorders, as at 17 and 18, are tandemly mounted on the lower end of the tail pipe 16. Those skilled in the art will, of course, recognize that the tool string 11 may also be arranged to include additional full-bore tools such as a fluid sampler, a jar, or a safety joint (not depicted in the drawings) should one or more of these typical tools also be needed for carrying out a particular testing or completion operation.

As will subsequently be explained in more detail, the new and improved full-bore valve 10 of the present invention is arranged in the tool string 11 above the test valve 15 and, in coordination with the operation of the test valve, selectively moved to a closed position for blocking fluid communication between the interior of the pipe string 12 and the well bore annulus above the packer 14 while the test valve is selectively opened and closed for performing a predetermined number of flow and shut-in tests of a selected earth formation in communication with the isolated interval of the well bore 13 below the packer. Thereafter, the test valve 15 is closed and the reversing valve 10 is selectively opened to permit any connate fluids remaining in the pipe string 12 to be displaced to the surface by applying an increased pressure to the fluids in the well bore annulus above the packer 14. If desired, the new and improved valve 10 can also be selectively operated to subsequently allow various completion fluids to be pumped through the pipe string 12 and selectively directed either into the isolated well bore interval below the packer 14 or into the annulus of the well bore 13 above the packer.

Figure 2A:
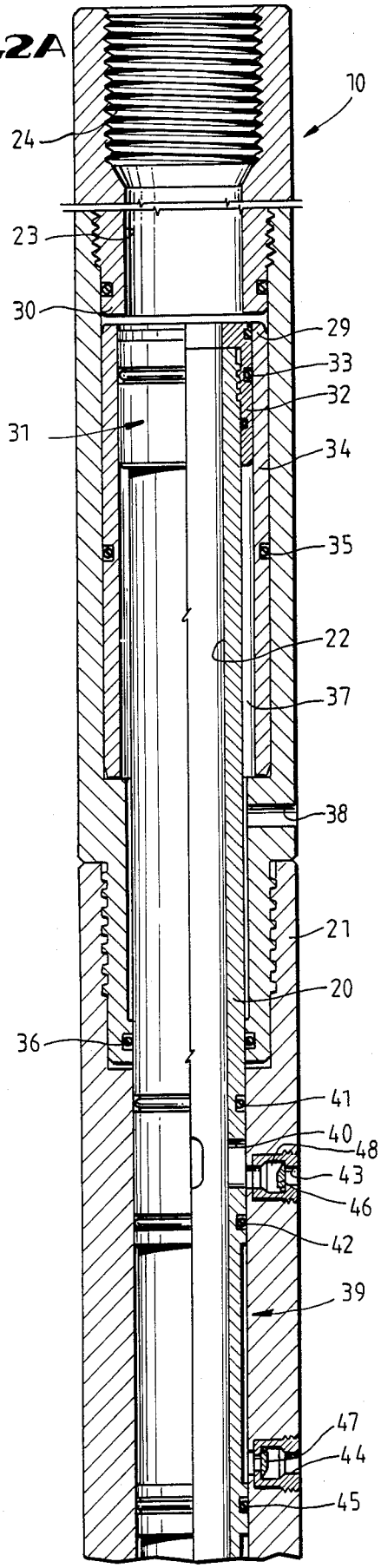
FIGS. 2A and 2B are successive cross-sectioned elevational views showing a preferred embodiment of the reversing valve depicted in FIG. 1.
Figure 2B:
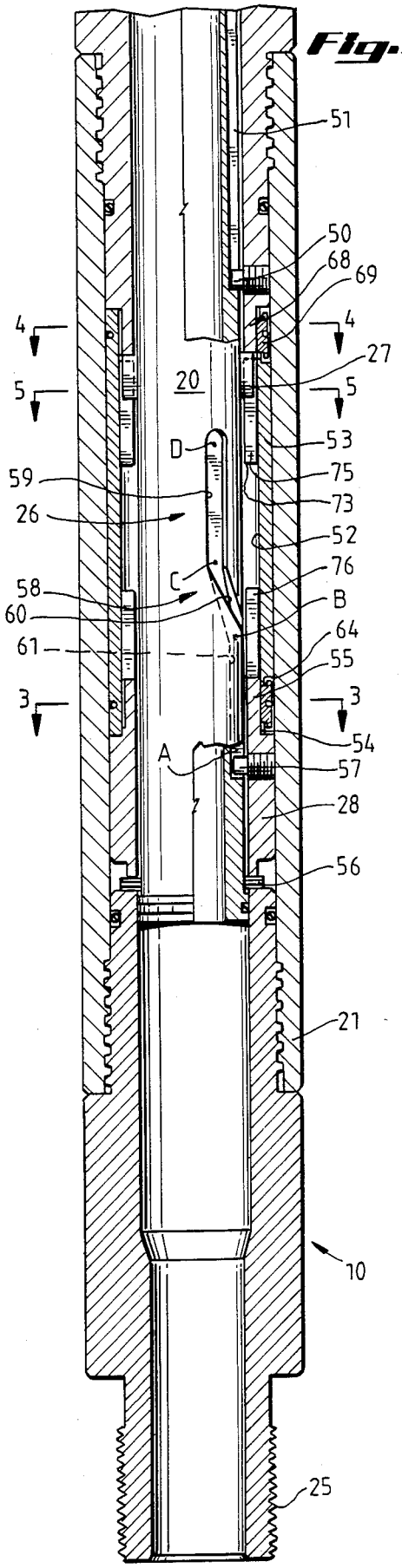

Turning now to FIGS. 2A and 2B, partially cross-sectioned elevational views are respectively shown of the upper and lower portions of a preferred embodiment of the new and improved valve 10 arranged in accordance with the principles of the present invention. As illustrated, the valve 10 includes a tubular mandrel 20 which is telescopically arranged for moving longitudinally within a tubular housing 21. As is typical with full-bore tools, the diameter of the axial bore 22 of the mandrel 20 is sized to be substantially equal to the internal diameter of the pipe string 12. To couple the valve 10 between the string of tools 11 and the pipe string 12, the upper end of the axial bore 23 of the housing 21 is provided with female threads 24 (FIG. 2A) suitably adapted for threadedly receiving the lower end of the pipe string 12 (FIG. 1). Similarly, the lower end of the housing 21 is provided with male threads 25 (FIG. 2B) for coupling the full-bore valve 10 to other tools in the tool string 11 therebelow (FIG. 1). Those skilled in the art will, of course, appreciate that to simplify the fabrication, assembly and maintenance of the valve 10, the mandrel 20 and the valve housing 21 are preferably comprised of interconnected sub-assemblies or individual components. To facilitate the following description of the full-bore valve 10, the interconnected sub-assemblies comprising the mandrel and the housing are simply designated by their respective reference numerals 20 and 21.

The new and improved valve 10 includes selectively-operable indexing means 26 which, as will be explained in more detail, are cooperatively arranged for establishing one operating mode for the full-bore valve in which its mandrel 20 is free to move longitudinally along an extended span of travel within the axial housing bore 23 between a lowermost operating position where a mandrel lug 27 engages the upper end of a sleeve 28 that is rotatably mounted within the housing (FIG. 2B) and its depicted uppermost operating position where an enlarged mandrel shoulder 29 engages an inwardly-directed shoulder 30 in the upper end of the housing (FIG. 2A). The indexing means 26 are also arranged for establishing another operating mode for the full-bore valve 10 in which the mandrel 20 is movable only along a more restricted or limited span of longitudinal travel that is preferably located midway between the above-described uppermost and lowermost positions of the mandrel.

To selectively move the mandrel 20 along either of its alternative travel spans, the new and improved valve 10 urther includes pressure-responsive actuating means 31 cooperatively arranged for longitudinally shifting the mandrel in response to changes in the pressure differential between the pipe string 12 and the annulus of the well bore 13. As depicted in FIG. 2A, in the preferred embodiment of the full-bore valve 10 the pressure-responsive actuating means 31 are comprised of an enlarged-diameter piston 32 on the upper end of the mandrel 20 carrying sealing means, such as an O-ring 33, slidably engaged within an elongated sleeve 34 that is secured in an enlarged upper portion of the internal bore 23 of the housing 21 and sealingly engaged therewith by an O-ring 35. Sealing means, such as an O-ring 36, are cooperatively arranged on the inner wall of the housing 21 so as to be slidably engaged by an intermediate portion of the mandrel 20 for defining an enclosed fluid chamber 37 in the housing bore 23 below the piston 32.

One or more lateral ports, as at 38, are arranged in the wall of the housing 21 for communicating the annular fluid chamber 37 with the well bore fluids outside of the housing. Since the mandrel 20 is otherwise uniform in diameter, those skilled in the art will, of course, recognize that the direction in which the mandrel moves with respect to the housing 21 will depend upon whether the pressure of the fluids in the enclosed chamber 37 is greater than or less than the pressure within the axial housing bore 23. The manner by which the pressure of the fluids in the chamber 37 is selectively controlled will be subsequently explained.

As seen in FIG. 2A, the new and improved full-bore valve 10 is further provided with valve means 39 having at least one lateral port 40 in an intermediate portion of the mandrel 20 and isolated by sealing means such as a pair of O-rings 41 and 42 mounted on the mandrel above and below the mandrel port. The valve means 39 also include upper and lower lateral ports 43 and 44 which are arranged in an intermediate portion of the housing 21 to provide fluid communication between the well bore 13 and the internal housing bore 23. In the preferred embodiment of the invention, the upper and lower housing ports are cooperatively located so that whenever the indexing means 26 permit the mandrel to be moved in its extended span of longitudinal travel, the isolated mandrel port 40 will be alternatively aligned with the housing port 43 and the housing port 44 whenever the mandrel is respectively located in its uppermost and lowermost positions. The valve means 39 further include additional sealing means such as an O-ring 45 cooperatively mounted around an intermediate mandrel portion so as to remain below the lower housing port 44 whenever the mandrel 20 is located in its uppermost operating position. For reasons which will subsequently be explained, the full-bore valve 10 also includes normally-closed check valves such as a pair of flapper valves 46 and 47 which are pivotally mounted within the housing 21 and respectively adapted for seating engagement with the upper and lower housing ports 43 and 44. It will be noted from FIG. 2A that the upper check valve 46 is cooperatively arranged to be unseated only in response to the entrance of fluids into the full-bore valve 10 by way of the upper port 43. Conversely, the lower check valve 47 will open only in response to the discharge of fluids from the full-bore valve 10 by way of the lower port 44. Although the check valves 46 and 47 can be spring biased to be normally closed, it is preferred to instead bevel the unsupported edge of the valve members, as at 48, so that a reverse flow through the ports 43 and 44 will act on the backside of the valve member and move it into seating engagement. It is also preferred that, if possible, the check valve members 46 and 47 be dependently supported within their respective ports 43 and 44 so that the flapper valves will normally remain in a seated position so long as there is no flow of fluids otherwise tending to lift the valve members away from their associated port.

Turning now to FIG. 2B, it will be seen that the mandrel 20 is secured against rotation with respect to the housing 21 by means such as an inwardly-directed housing spline or pin 50 slidably engaged in a longitudinal mandrel groove 51 of sufficient length that the mandrel can move freely in each of its two travel spans. As illustrated, the lower portion of the new and improved full-bore valve 10 is shown with the indexing means 26 being selectively positioned whereby the mandrel 20 is capable of being shifted longitudinally downwardly from its depicted uppermost operating position to its lowermost operating position where the mandrel lug 27 engages the upper end of the sleeve 28 which is rotatably mounted in an enlarged annular space 52 in the lower portion of the housing 21. In its preferred embodiment, the new and improved indexing means 26 further include a second sleeve 53 which is rotatably disposed in the annular space 52 and has its lower end portion 54 coaxially interfitted over the reduced-diameter upper end portion 55 of the lower sleeve 28. The sleeves 28 and 53 are preferably urged together by biasing means such as a flat spring or Belleville washer 56 arranged between the lower end surface of the annular space 52 and the bottom of the lower sleeve.

The rotatably mounted lower sleeve 28 carries an inwardly projecting indexing pin 57 that is slidably engaged in an outwardly facing indexing groove 58 which is cooperatively formed in the adjacent exterior surface of the mandrel 20 to define an upper longitudinal groove portion 59 which is closed at its upper end and has its lower end opening into an intermediately located inclined groove portion 60 that, in turn, opens into the upper end of a lower longitudinal groove portion 61 that is angularly offset in relation to the upper groove portion. It will be appreciated from FIGS. 2A and 2B that the overall length of the lower groove portion 61 is such that the mandrel 20 can be moved downwardly relative to the housing 21 a sufficient distance to carry the mandrel port 40 and its two associated O-rings 41 and 42 from their depicted uppermost port-opening position to a somewhat lower port-closing position where the O-ring 41 has been moved slightly below the upper housing port 43 before the upper end of this lower groove portion has passed the indexing pin 57. In a similar fashion, it will be seen that the length of the upper groove portion 59 is such that upward travel of the mandrel 20 will carry the mandrel port 40 and the two O-rings 41 and 42 from a lowermost port-opening position in relation to the lower housing port 44 to a somewhat higher port-closing position where the O-ring 42 has been moved slightly above the lower housing port before the lower end of the upper groove portion passes the indexing pin 57.

Accordingly, the longitudinal travel of the mandrel 20 while the indexing pin 57 is confined in the lower groove portion will be effective for selectively opening and closing the upper housing port 43. Thus, when the mandrel 20 is located in its depicted uppermost position where the indexing pin 57 is in the lower end "A" of the lower groove portion 61, the mandrel port 40 will be in communication with the housing port 43. Conversely, when the mandrel 20 is moved a short distance downwardly so as to locate the pin 57 in the upper end "B" of the lower groove portion, the upper housing port 43 will be closed. In a similar fashion, the longitudinal travel of the mandrel 20 while the indexing pin is confined in the upper groove portion 59 will correspondingly control the opening and closing of the lower housing port 44, with the lower housing port being open when the indexing pin 57 is in the upper end "D" of the upper groove portion and the lower housing port being closed when the mandrel is positioned to locate the indexing pin in the lower end "C" of the upper groove portion.

It will be seen, however, that the longitudinal travel of the mandrel 20 while the indexing pin 57 is in the inclined groove portion 60 will not be effective for opening either of the two housing ports 43 and 44. Nevertheless, it will be seen that as the mandrel 20 is moved either upwardly or downwardly while the indexing pin 57 is slidably disposed within the inclined groove portion 60, the camming action of the pin against the side walls of the inclined groove portion will be effective to turn the sleeve 28 through an arc corresponding to the angular spacing of the upper and lower groove portions 59 and 61. Thus, upward travel of the mandrel 20 will turn the sleeve 28 in one direction and downward travel of the mandrel will turn the sleeve in the opposite rotational direction.

Figure 3:
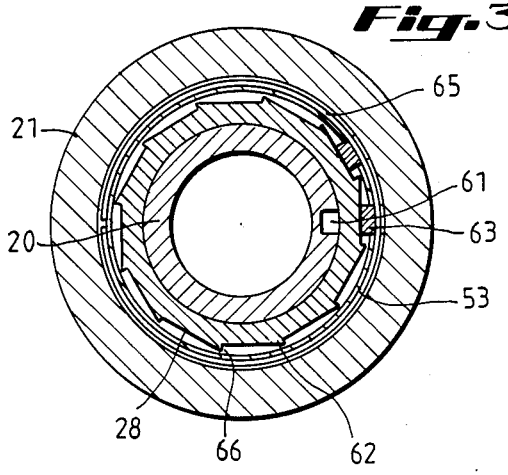
FIGS. 3–5 are cross-sectional views respectively taken along the lines "3—3", "4—4" and "5—5" in FIG. 2B.

To utilize this rocking motion of the lower sleeve 28, the indexing means 26 further include a plurality of ratchet teeth 62 which, as best seen in FIG. 3, are uniformly spaced around the external surface of the reduced-diameter end portion 55 of the lower sleeve 28. A ratchet pawl 63 is loosely fitted in a lateral opening 64 in the lower end portion of the upper sleeve 53 and normally biased inwardly by means such as a typical garter spring 65 to engage whichever one of the ratchet teeth 62 that is then angularly aligned with the opening and the pawl.

It will be appreciated, of course, that the angular spacing between each of the ratchet teeth 62 is substantially equal to the angular spacing between the upper and lower groove portions 59 and 61. Thus, whenever the mandrel 20 is shifted upwardly, the camming action of the indexing pin 57 in the inclined groove portion 60 will correspondingly turn the lower sleeve 28 so that as the upright shoulders, as at 66, formed at the ends of the ratchet teeth 62 successively engage the ratchet pawl 63, the upper sleeve 53 will be incrementally advanced to each of its angular positions. Then, whenever the mandrel 20 is shifted downwardly, the camming action of the indexing pin 57 and the inclined groove portion 60 will return the lower sleeve 28 to the angular position defined by the upper groove portion 59. As the lower sleeve 28 returns to that angular position, the angular spacing of the several ratchet teeth 62 will cause the ratchet tooth which is then in engagement with the pawl 63 to be rotated from under the pawl thereby allowing the pawl to be biased into engagement with the next-adjacent ratchet tooth. Then, whenever the mandrel 20 is again moved upwardly, the cooperative action of the ratchet teeth 62 and the pawl 63 will again advance the upper sleeve 53 to its next angular position.

Figure 4:
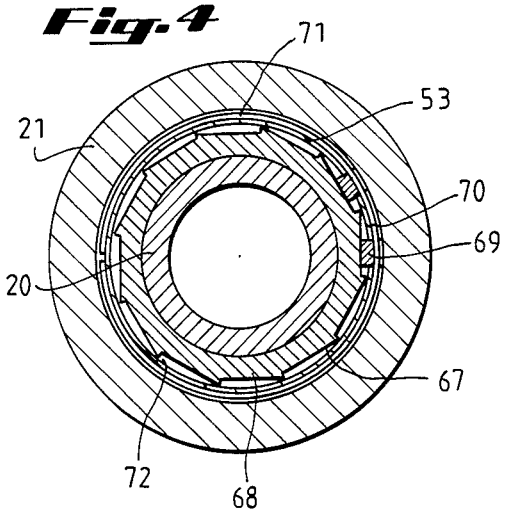
Figure 5:
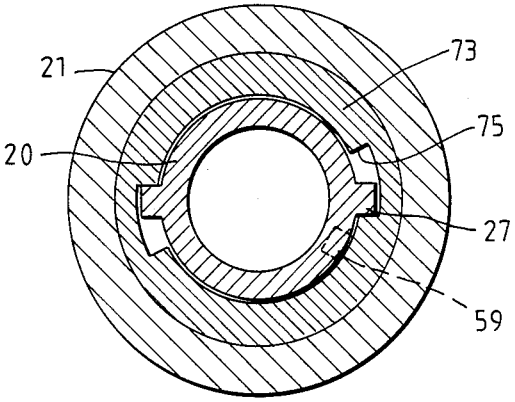

To prevent retrograde rotational movement of the upper sleeve 53 whenever the mandrel 20 is again moved downwardly, the indexing means 26 preferably include a second set of outwardly facing ratchet teeth 67 which, as depicted in FIG. 4 are cooperatively located around a depending reduced-diameter housing shoulder 68 which projects into the upper end of the upper sleeve 53. A second pawl 69 is cooperatively arranged within an opening 70 in the upper sleeve 53 and biased into engagement with the ratchet teeth 67 by a typical garter spring 71. Accordingly, as the upper sleeve 53 is successively turned with respect to the housing 21, the pawl 69 will be correspondingly shifted from one to another of the ratchet teeth 67 with a minimum of effort. However, should the return movements of the lower sleeve 28 tend to carry the upper sleeve 53 in the reverse direction, the pawl 69 and the upright shoulders 72 on the ends of the ratchet teeth 67 will cooperate to prevent such retrograde movement of the upper sleeve.

As previously mentioned, the new and improved valve 10 is shown in FIGS. 2A and 2B with the mandrel 20 being ready to move from its depicted uppermost operating position to its lowermost operating position. To control this movement, the indexing means 26 further include inwardly directed annular shoulders 73 and 74 which are respectively arranged around the upper and lower ends of the upper sleeve 53 and provided with longitudinally aligned slots, as at 75 and 76, of sufficient angular width to readily pass or receive the mandrel lug 27 whenever the mandrel 20 is being shifted in its extended span of longitudinal travel between its uppermost and lowermost operating positions (i.e., where the indexing pin is respectively located in the positions "A" and "D"). It will, however, be recognized that unless the upper sleeve 53 is angularly positioned to longitudinally align the slots 75 and 76 with the mandrel lug 27, the lug is effectively trapped within the mid-portion of the annular space 52 within the upper sleeve which lies between the opposing surfaces of the sleeve shoulders 73 and 74. This, of course, correspondingly restricts or limits the longitudinal movement of the mandrel 20 to the reduced travel span defined by the spacings between the opposed surfaces of the mandrel lug 27 and the upper and lower sleeve shoulders 73 and 74 (i.e., where the indexing pin 57 is respectively located in the positions "B" and "C"). Thus, so long as the mandrel lug 27 is not longitudinally aligned with the slots 75 and 76 the mandrel 20 will be limited to its restricted travel span leaving the housing ports 43 and 44 closed.

Accordingly, it will be recognized that the new and improved indexing means 26 cooperate to retain the mandrel 20 in its restricted longitudinal span of travel until the slots 75 and 76 have been moved into longitudinal alignment with the mandrel lug 27. With only one set of aligned slots 75 and 76, this alignment can, of course, occur in only a single angular position of the upper sleeve 53 in relation to the mandrel 20 and the housing 21. Thus, once the slots 75 and 76 are moved out of alignment with the lug 27, the mandrel 20 must be successively reciprocated until the cooperative action of the ratchet teeth 62 and the pawl 63 has incrementally advanced the upper sleeve 53 completely around the mandrel 20 and the slots and mandrel lug are again angularly aligned. This realignment, of course, requires that the mandrel 20 be reciprocated once for each of the ratchet teeth 62 so that the number of these teeth will determine how many times the mandrel must be reciprocated in its restricted span of longitudinal travel (between the positions "B" and "C") before the indexing means 26 cooperate to allow the mandrel to move in its greater span of travel (between the positions "A" and "D") for selectively opening the upper and lower housing ports 43 and 44.

Accordingly, it will be recognized that when the new and improved reversing valve 10 is operated in conjunction with a pressure-actuated test valve, as at 15, the test valve can be successively opened and closed a predetermined number of times without opening the reversing valve. This will, of course, allow the operator to conduct a number of flow and shut-in tests without communicating the annulus of the well bore 13 with the interior of the pipe string 12. With the teeth 62 arranged as shown in FIG. 3, it will be recognized that the reversing valve 10 will open only once for every twelve changes in the pressure differential between the fluids in the pipe string 12 and in the annulus of the well bore 13. Thus, should only a few flow tests be conducted before it is desired to open the reversing valve 10 to displace the connate fluids in the pipe string 12 to the surface, it will be necessary to effect however many pressure differential changes are needed to incrementally advance the sleeve 53 around to the angular position where the slots 75 and 76 are aligned with the mandrel lug 27. Once the slots 75 and 76 are aligned with the mandrel lug 27, the next change in pressure differential will be effective for shifting the mandrel 20 to its uppermost position "A" and thereby open the reversing ports 43. Then, by applying pressure to the fluids in the annulus of the well bore 13, the annulus fluids will be displaced into the pipe string 12 to transport any connate fluids therein to the surface for recovery. The check valve 46 will, of course, function to allow the annulus fluids to enter the valve 10. Since the slots 75 and 76 are still aligned, it will be recognized that the next change in pressure differential will be effective for shifting the mandrel 20 along its extended span of longitudinal travel from its uppermost or so-called "reversing position" at "A" to its lowermost or so-called "circulating position" at "D". Once the mandrel 20 is in this latter position, the port 44 will then be opened to permit fluids to be pumped downwardly through the pipe string 12 and into the annulus of the well bore 13 above the packer 14. It will be recognized that since there is no spring force to overcome, only a minimum pressure force is required to shift the mandrel 20 downwardly so that any type of completion fluid may be easily discharged at even low flow rates into the annulus of the well bore 13.

Whether or not fluids are pumped downwardly through the pipe string 12, it will be recognized that the next change in the pressure differential acting on the piston means 32 will shift the mandrel 20 upwardly and thereby bring the indexing pin 57 into the inclined groove portion 60 to incrementally advance the sleeve 53 to its first angular position where the mandrel is again limited to its restricted span of longitudinal travel. At this point, the new and improved reversing valve 10 is again closed and in position to begin a second operating cycle if the operator so desires. The test valve 15 can, therefore, again be operated without reopening the reversing valve 10 until after a predetermined number of pressure differential changes are imposed on the new and improved valve.

It will, of course, be appreciated that at times only a limited number of tests need be completed before the reversing valve 10 is opened. Although the new and improved valve 10 can be left as illustrated where twelve pressure differential changes are required to complete an entire operating cycle, it is also proposed to incorporate a second groove system (not shown in the drawings) on the mandrel 20 in which the angular spacing between the longitudinal groove portions is twice the spacing between the depicted groove portions 59 and 61. Thus, should a fewer number of pressure changes be desired to complete a full operating cycle of the tool 10, the two lower members of the housing 21 can be removed while the tool is at the surface and reassembled with the indexing pin 57 in this alternative groove system. The ratchet teeth 62 and 67 and their respective ratchet pawls 63 and 69 will still function as previously described except that the lower sleeve will instead be incrementally advanced through an arc that is twice the arc as previously described and the pawls will pass over every other tooth before being halted.

Accordingly, it will be appreciated that the present invention has provided new and improved methods and apparatus for conducting various testing and completion operations in a well bore by successively changing the pressure differential between the fluids in the well bore annulus and the fluids in a pipe string supporting the apparatus of the present invention. By successively changing this pressure differential, first and second tools in a given tool string can be selectively operated without having to remove the tool string from the well bore to reset one of the tools. In this manner, a number of different testing or completion operations can be reliably carried out in a minimum of time.

While only one particular embodiment of the present invention has been shown and described herein, it is apparent that various changes and modifications may be made thereto without departing from this invention in its broader aspects; and therefore, the aim in the appended claims is to cover all such changes and modifications that fall within the true spirit and scope of this invention.

What is claimed is:

1. A method for selectively controlling communication between the fluids in a well bore and the fluids in a pipe string having a reversing valve connected thereto including a housing with upper and lower ports therein, and valve means operatively disposed in said housing for movement in an extended span of travel between upper and lower port-opening positions in response to successive changes in the direction of the pressure differential between said fluids and comprising the steps of:

providing stop means movable into a blocking position to first limit said valve means to movement back and forth in a restricted portion of said span of travel between upper and lower port-closing positions;

providing indexing means responsive to a predetermined number of said pressure differential changes for progressively moving said stop means away from said blocking position and thereby freeing said valve means to then move in said extended span of travel; repetitively changing the direction of said pressure differential between said fluids for progressively moving said stop means out of said blocking position to free said valve means to move in one direction along said extended span of travel to one of said port-opening; positions; and whenever said valve means move to said one port-opening position again changing the direction of said pressure differential between said fluids for selectively moving said valve means in the opposite direction along said extended span of travel to the other of said port-opening positions while said stop means are out of said blocking position.

2. The method of claim 1 further including the step of again changing the direction of said pressure differential between said fluids for selectively returning said stop means to said blocking position.

3. The method of claim 1 further including the step of pumping said well bore fluids into said pipe string while said valve means are in said one port-opening position.

4. The method of claim 1 further including the step of pumping fluids from the interior of said pipe string into said well bore while said valve means are in said other port-opening position.

5. The method of claim 4 further including the step of pumping said well bore fluids into said pipe string while said valve means are in said one port-opening position.

6. Apparatus adapted to be coupled in a pipe string suspended in a well bore and comprising:

a tubular housing having upper and lower ports arranged therein communicating the interior and exterior of said housing;

valve means cooperatively arranged in said housing for moving longitudinally toward a first port-opening position in relation to one of said ports only in response to an increased pressure in said housing greater than the exterior pressure and for moving longitudinally toward a second port-opening position in relation to the other of said ports only in response to an increased exterior pressure greater than the interior pressure therein;

indexing means including a sleeve member rotatably arranged on said valve means, and ratchet-and-pawl means cooperatively arranged for incrementally advancing said sleeve member between multiple angularly-spaced positions around said valve means in response to said longitudinal movements of said valve means; and first and second stop means cooperatively arranged on said valve means and said sleeve member respectively for limiting movement of said valve means to a restricted travel span between upper and lower port-closing positions lying between said upper and lower ports and thereby blocking movement of said valve means beyond said restricted travel span to either of said port-opening positions until said sleeve member has been advanced to a predetermined one of its said angularly-spaced positions.

7. The well bore apparatus of claim 6 further including second ratchet-and-pawl means cooperatively arranged for preventing retrograde movement of said sleeve member as it is successively advanced to each of its angularly-spaced positions.

8. The well bore apparatus of claim 6 further including first and second check valve means cooperatively arranged in said upper and lower ports respectively, one of said check valve means being cooperatively arranged for preventing fluid flow from within the interior of said housing to its exterior and the other of said check valve means being cooperatively arranged for preventing fluid flow from the exterior of said housing to its interior.

9. Apparatus adapted to be coupled in a pipe string suspended in a well bore and comprising:

a tubular housing having upper and lower ports arranged therein communicating the interior and exterior of said housing;

valve means including a valve member cooperatively arranged in said housing and piston means on said valve member operative for moving said valve member longitudinally toward a first port-opening position in relation to one of said ports only in response to an increased pressure in said housing greater than the exterior pressure and for moving said valve member longitudinally toward a second port-opening position in relation to the other of said ports only in response to an increased exterior pressure greater than the interior pressure therein; first and second sleeve members rotatably arranged on said valve member;

indexing means cooperatively arranged between said first sleeve member and said valve member including a groove system in one of the members having upper and lower longitudinal portions that are angularly displaced in relation to one another and joined at their adjacent ends by an inclined portion, and a pin fixed on the other of the members and movably disposed in said groove system for rocking said first sleeve member back and forth between two angularly-spaced positions as said pin passes upwardly and downwardly through said groove portions;

ratchet-and-pawl means cooperatively arranged between said first and second sleeve members for incrementally advancing said second sleeve member between multiple angularly-spaced positions in response to the back and forth movements of said first sleeve member; and first and second stop means cooperatively arranged on said valve member and said second sleeve member respectively for limiting longitudinal movement of said valve member to a restricted travel span between upper and lower port-closing positions and blocking longitudinal movement of said valve member to either of its said port-opening positions until said second sleeve member has been advanced to a predetermined one of its said angularly-spaced positions.

10. The apparatus of claim 9 wherein said indexing means further include a second groove system in said one member having upper and lower longitudinal portions that are angularly displaced further apart than said upper and lower longitudinal portions in said first groove system so that when said fixed pin is instead disposed in said second groove system, said second sleeve member will advance further in response to each back and forth movement of said first sleeve member.

* * * * *